US010386142B2

(12) United States Patent
Brown

(10) Patent No.: US 10,386,142 B2
(45) Date of Patent: Aug. 20, 2019

(54) REVERSIBLE BOLT FOR AMBIDEXTROUS EJECTION

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 15/985,954

(22) Filed: May 22, 2018

(65) Prior Publication Data

US 2018/0356171 A1 Dec. 13, 2018

Related U.S. Application Data

(60) Provisional application No. 62/516,716, filed on Jun. 8, 2017.

(51) Int. Cl.

| | |
|---|---|
| ***F41A 15/14*** | (2006.01) |
| ***F41A 35/06*** | (2006.01) |
| ***F41A 3/26*** | (2006.01) |
| ***F41A 11/02*** | (2006.01) |

(52) U.S. Cl.

CPC ..... *F41A 15/14* (2013.01); *F41A 3/26* (2013.01); *F41A 11/02* (2013.01); *F41A 35/06* (2013.01)

(58) Field of Classification Search

CPC .... F41A 35/06; F41A 3/16; F41A 3/26; F41A 15/14

See application file for complete search history.

(56) References Cited

U.S. PATENT DOCUMENTS

| | | | | |
|---|---|---|---|---|
| 2,951,424 | A | 9/1960 | Stoner | |
| 3,882,625 | A * | 5/1975 | Tellie | F41A 3/12 42/25 |
| 6,536,150 | B2 * | 3/2003 | Schweikart | F41A 3/26 42/16 |
| 6,625,917 | B2 * | 9/2003 | Murello | F41A 3/26 42/16 |
| 7,395,626 | B2 * | 7/2008 | Zedrosser | F41A 15/14 42/25 |
| 8,745,911 | B2 * | 6/2014 | Zheng | F41A 15/14 42/16 |
| 9,032,860 | B2 * | 5/2015 | Faxon | F41A 15/14 89/193 |
| 10,036,600 | B2 | 7/2018 | Maranli | |

FOREIGN PATENT DOCUMENTS

| | | | | |
|---|---|---|---|---|
| CH | 580269 | A5 * | 1/1975 | F41A 35/02 |
| CH | 580269 | A5 * | 9/1976 | F41A 35/02 |

* cited by examiner

*Primary Examiner* — Joshua T Semick

(74) *Attorney, Agent, or Firm* — Wood Herron & Evans LLP

(57) ABSTRACT

Provided is a firearm bolt having a rotating bolt body with a longitudinal axis with an extractor on the bolt body at a radial position relative to the axis. There are at least first and second transverse bores in the bolt body at an acute angle to one another converging at the longitudinal axis for selectively receiving a cam pin. Configuration of the bolt in a bolt carrier with a cam pin in the first transverse bore positions the extractor for interaction with an ejector to eject a cartridge casing to one side, and configuration with the cam pin in the second transverse bore positions the extractor for interaction with an ejector to eject a cartridge casing to an opposite side.

9 Claims, 9 Drawing Sheets

REVERSIBLE BOLT FOR AMBIDEXTROUS EJECTION

RELATED APPLICATIONS

This application claims priority to U.S. Provisional Patent Application No. 62/516,716, filed Jun. 8, 2017, and incorporates the same herein by reference.

TECHNICAL FIELD

This invention relates to a firearm having a bolt that can be rotatably reconfigured within a bolt carrier to eject a spent casing toward either the left or right side.

BACKGROUND

Most semi-automatic (and many fully automatic) firearms eject spent casings to one side. Ejection is accomplished by cooperation between an extractor and an ejector as the spent casing is removed from the chamber when the action cycles. Generally, the extractor grips an edge of the cartridge rim and the ejector contacts the base at an approximately diametrically opposite point to fling the shell through the ejection port of the firearm's receiver. AR-pattern firearms include, but are not limited to, the AR10, AR15, M16, M4, and other variants in a rifle or pistol configuration. In an AR-pattern firearm, ejection is generally to the right, because most shooters are right-handed, although left-handed AR-pattern firearms have been made in which every part is produced as a mirror image of the standard. In an AR-pattern firearm, ejection is not directly to the side, but rather at an inclined angle, approximately 67.5 degrees from vertical (or 22.5 degrees above horizontal).

Various mechanisms have been used to allow selection between left-hand ejection and right-hand ejection in a single firearm. These, however, use complex switching mechanisms and/or many parts non-standard to an AR-pattern firearm.

SUMMARY OF THE INVENTION

The present invention provides a firearm bolt with a bolt body having a longitudinal axis and an extractor on the bolt body at a radial position relative to the axis. At least first and second transverse bores are provided in the bolt body at an angle to one another converging at the longitudinal axis for selectively receiving a cam pin. The configuration of the bolt in a bolt carrier with a cam pin in the first transverse bore positions the extractor for interaction with an ejector to eject a cartridge casing to one side, and configuration with the cam pin in the second transverse bore positions the extractor for interaction with an ejector to eject a cartridge casing to an opposite side.

This invention allows selection of ejection direction with the fewest nonstandard parts and can easily be changed by the user without special tools or separate parts. It can be used in a direct impingement or gas piston system. In a direct impingement system, the rotating bolt body has an annular shoulder providing a piston surface and can have a boss extending around a portion of the annular shoulder. A gas chamber is defined in a bolt carrier body by a portion of a longitudinal bore and the annular shoulder of the bolt and a gas key directs gas into the gas chamber. The annular shoulder defines a movable piston to allow the volume of the chamber to vary when axially displaced relative to the bolt carrier body. The carrier body can have side gas vents on opposite sides of the bolt carrier body, providing fluid communication between one portion of the gas chamber and the atmosphere. When the bolt is in the bolt carrier with a cam pin in the first transverse bore, the extractor and ejector eject a cartridge casing to one side through a first ejection port and the boss blocks the opposite side gas vent. When the configuration is reversed with the cam pin in the second transverse bore, the extractor and ejector eject a cartridge casing to the opposite side through the second ejection port and the boss blocks the other side gas vent.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
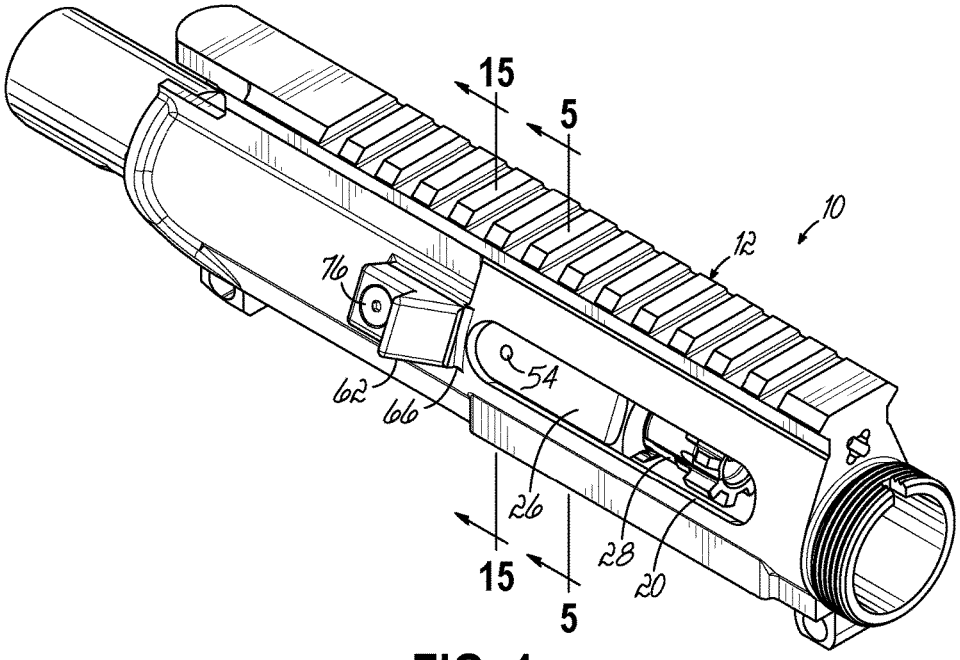
FIG. 1 is a first isometric view of an upper receiver of an AR-pattern showing a partially retracted bolt carrier and bolt according to an embodiment of the present invention in a first configuration to eject toward the right.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
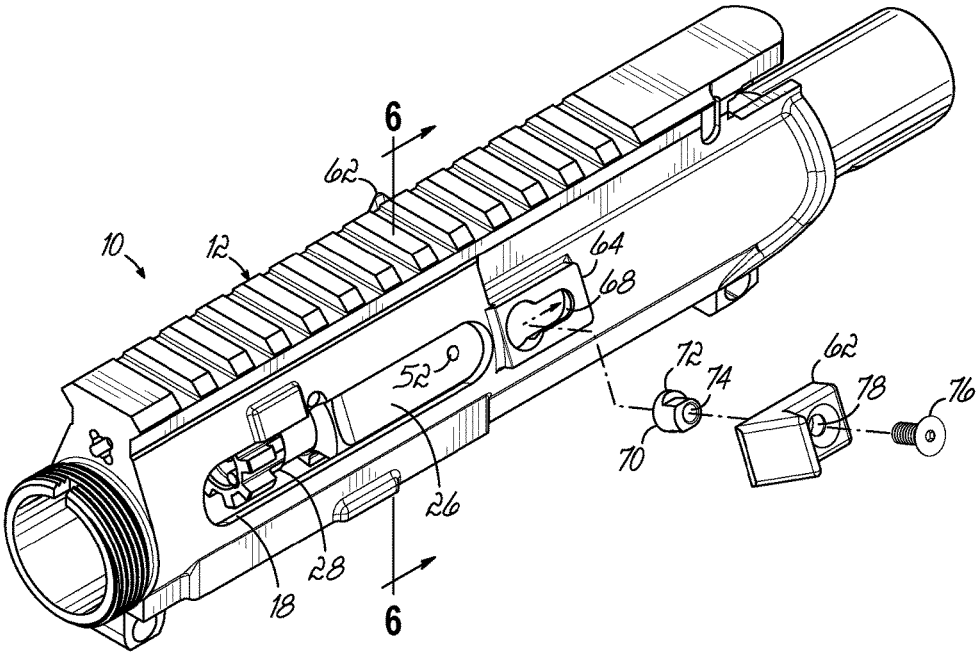
FIG. 2 is an opposite isometric view thereof.
Figure 3:
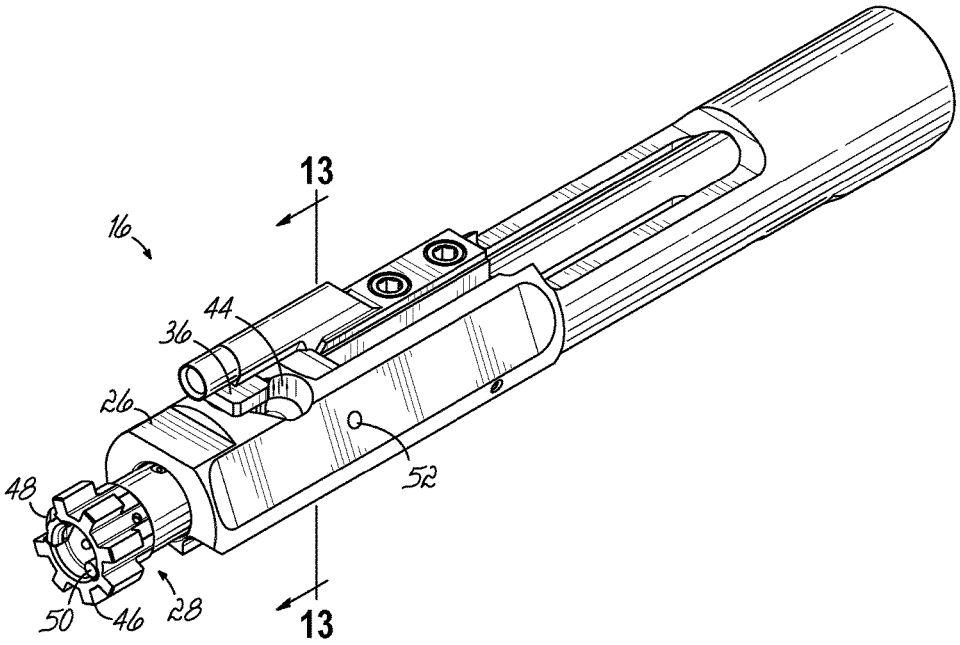
FIG. 3 is an isometric view of a bolt carrier and bolt assembly according to an embodiment of the present invention with the bolt in a first configuration to eject toward the right.
Figure 4:
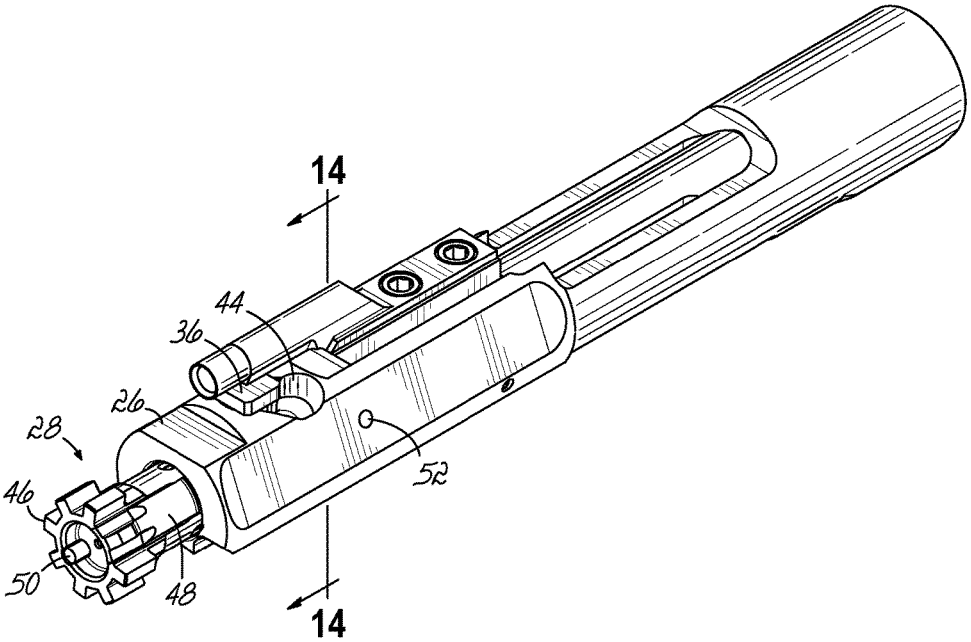
FIG. 4 is a similar view with the bolt reconfigured to eject toward the left.
Figure 6:
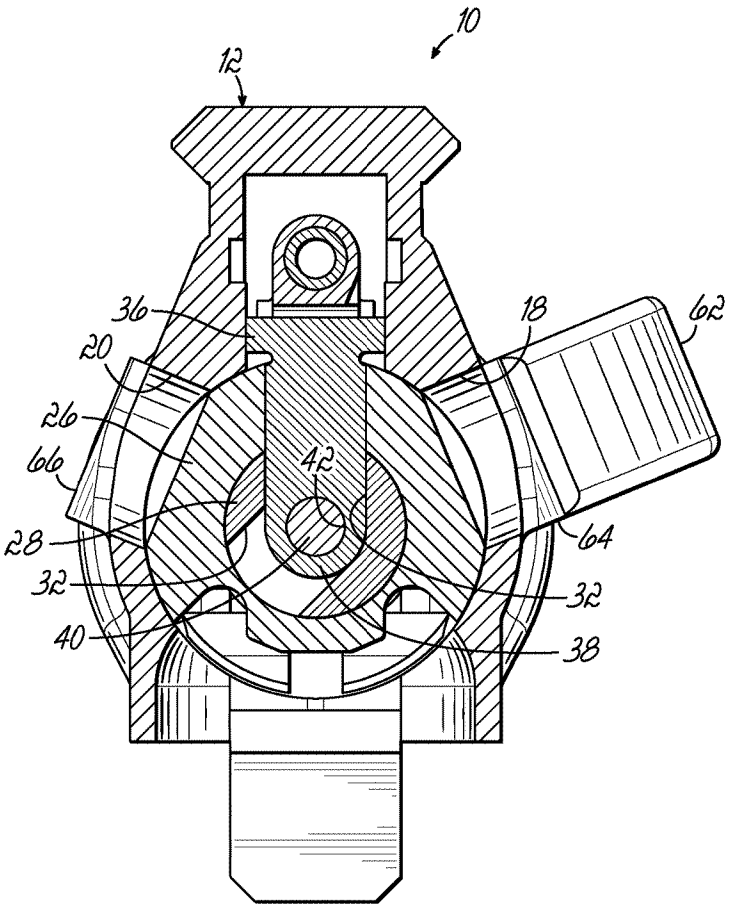
FIG. 6 is a similar cross-sectional view taken substantially along line 6-6 of FIG. 2 showing the bolt in a second configuration.
Figure 5:
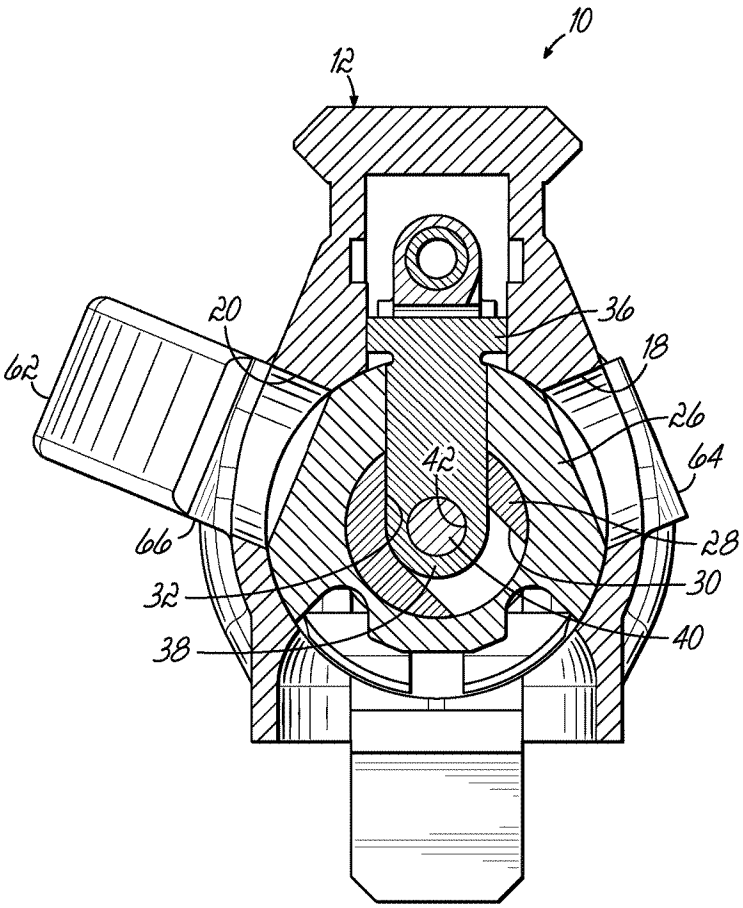
FIG. 5 is a cross sectional view taken substantially along line 5-5 of FIG. 1 showing the bolt in a first configuration.
Figure 7A:
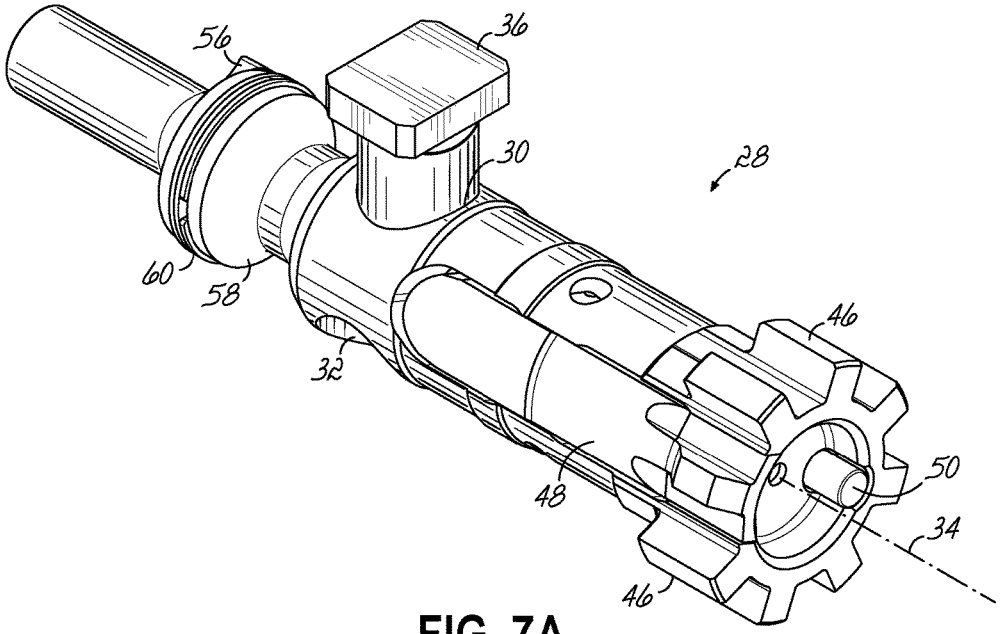
FIG. 7A is an isometric view of a bolt and cam pin positioned according to a first configuration similar to that shown in FIG. 3.
Figure 7B:
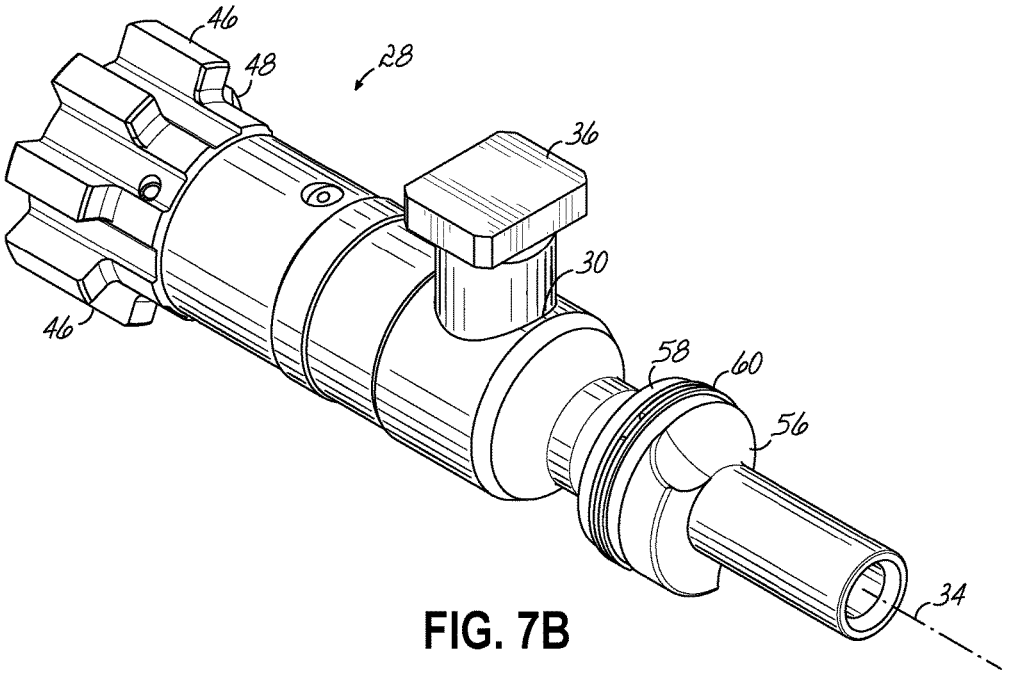
FIG. 7B is an opposite isometric view thereof.
Figure 8A:
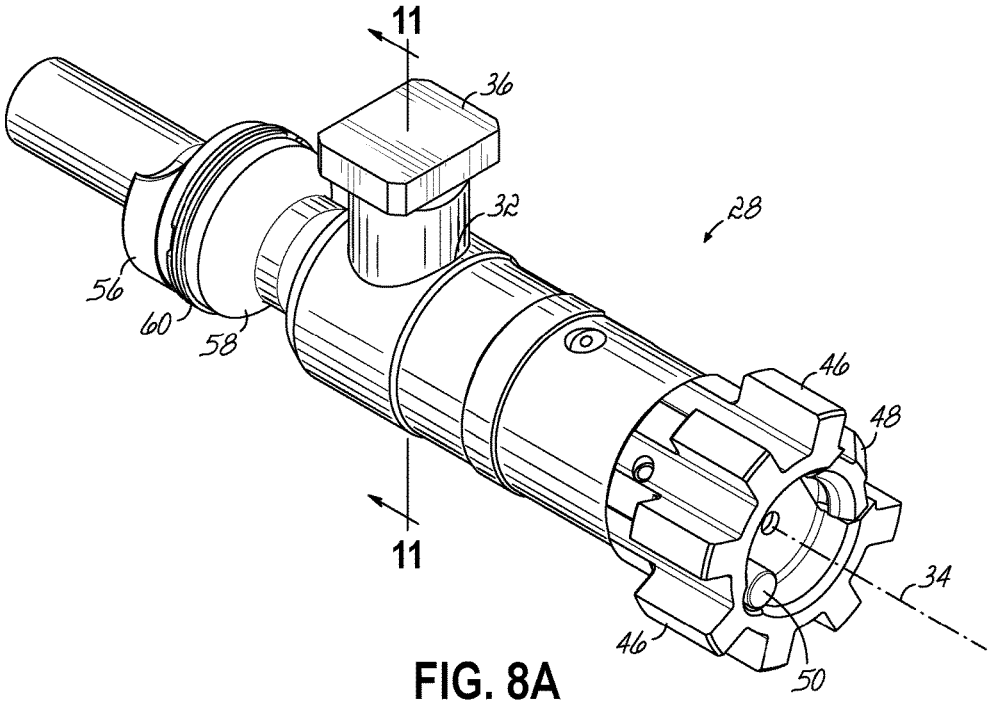
FIG. 8A is an isometric view of the bolt and cam pin in a second configuration similar to that shown in FIG. 4.
Figure 8B:
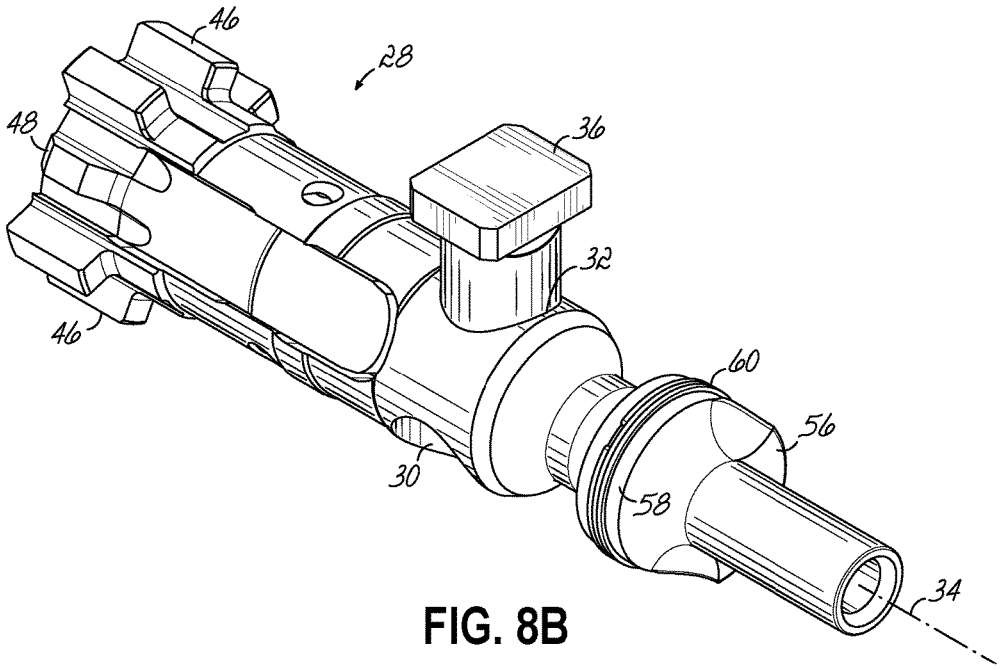
FIG. 8B is an opposite isometric view thereof.
Figure 9:
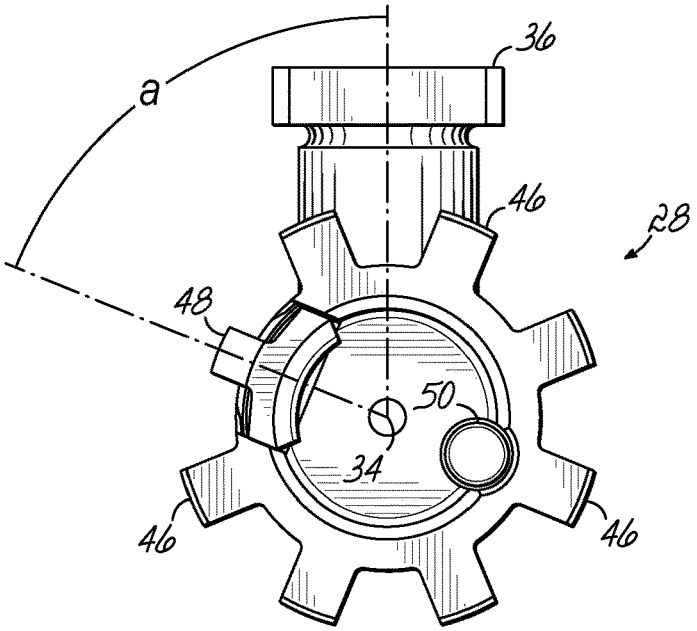
FIG. 9 is front elevation view of the bolt and cam pin shown in FIG. 7.
Figure 10:
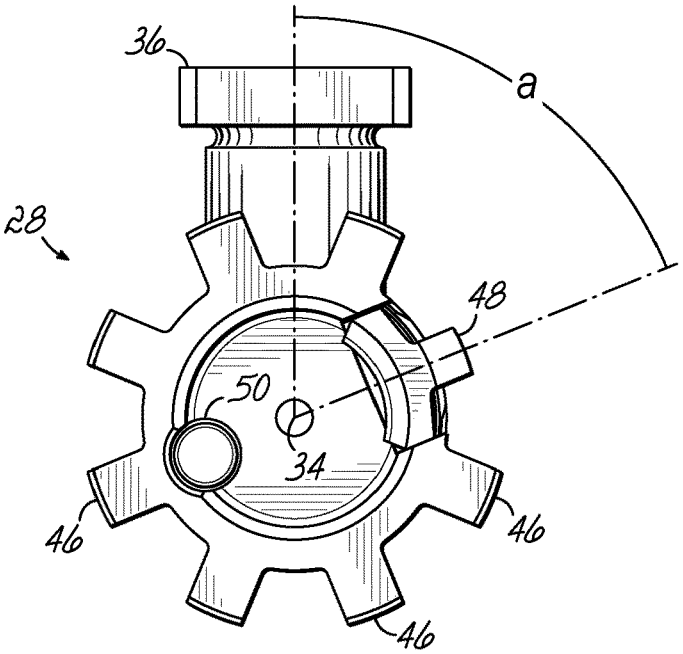
FIG. 10 is a front elevation view of the bolt and cam pin shown in FIG. 8.
Figure 11:
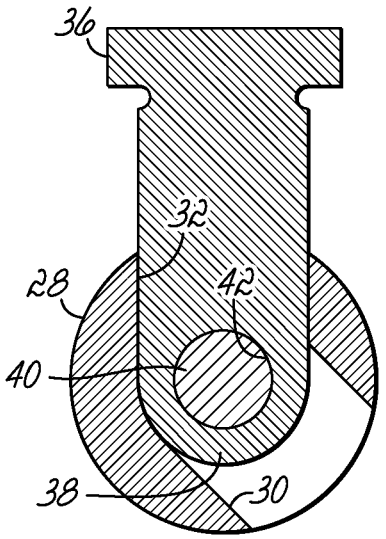
FIG. 11 is a cross sectional view of the bolt and cam pin taken sustainably along line 11-11 of FIG. 8.

Referring first to FIGS. 1 and 2, therein is shown at 10 an upper receiver assembly that includes a reversible bolt according to one embodiment of the present invention. The upper assembly 10 illustrated includes an upper receiver 12 and a bolt carrier assembly 16 that reciprocates within the upper receiver 12 when the action is cycled for semiautomatic or fully automatic fire. The upper receiver 12 may include left and right ejection ports 18, 20 on opposite sides.

As is well known in the prior art, an AR-pattern bolt includes a series of radially extending and circumferentially spaced lugs that engage the breach of the chamber (not shown) and lock when the bolt is rotated. Rotation of the bolt is accomplished by engagement between a cam pin that is inserted into a transverse bore of the bolt and which slides along a helical groove in the bolt carrier as the bolt and bolt carrier move axially relative to one another.

Referring now also to FIGS. 3-6, according to one aspect of the present invention, a bolt 28 is provided with first and second transverse bores 30, 32 formed at an angle to each other that converge at an axial center line 34. In preferred form, the cam pin 36 has an end portion 38 with a hemispherical shape having a radius corresponding to that of the cam pin 36 itself. Typically, the cam pin has a diameter of about 0.312", so the radius is about 0.156". As in the prior art, the cam pin 36 is held in position in the bolt 28 by a firing pin 40 that extends through an opening 42 in the cam pin that is coaxial with the axial center line 34 of the bolt 28, when assembled. The transverse bores 30, 32 may extend all the way through the body of the bolt 28 or, preferably, converge at the axial centerline 34. The transverse bores 30, 32 may be formed, for example, using a 0.312" diameter ball end mill so that the intersection is radiused from the central axis of the bores 30, 32 and the axial centerline 34 of the bolt 28 (which corresponds to a center axis of the opening 42).

As is well known in the art, the bolt 28 is rotated as the bolt carrier body 26 is moved axially relative to the bolt 28 and as the cam pin 36 is moved along a helical slot 44 in the bolt carrier body 26. When the bolt 28 is out of battery, the cam pin 36 is rotated to a generally upright position, as illustrated in FIGS. 3-11. As the bolt 28 and bolt carrier assembly 16 are moved into battery, the cam pin 36 slides along the helical slot 44, rotating the bolt 28 to lock the bolt lugs 46 into the breach of the barrel 14.

Figure 12:
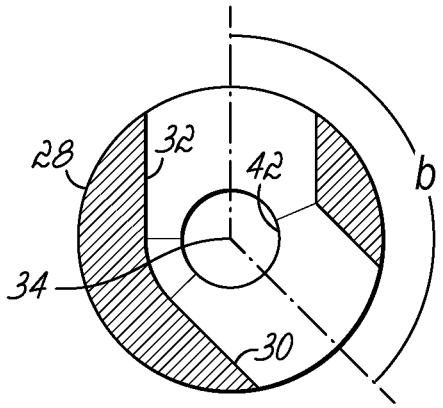
FIG. 12 is a similar sectional view showing the cam pin and firing pin removed to illustrate the converging cam pin bores.
Figure 13:
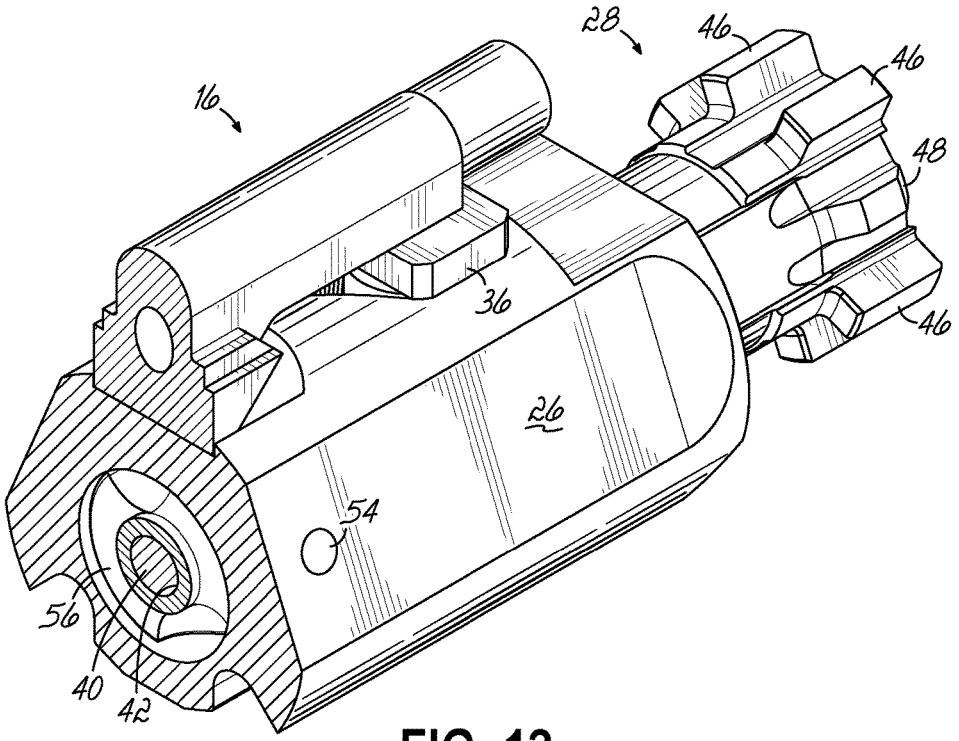
FIG. 13 is an isometric cross-sectional view taken substantially along line 13-13 of FIG. 3.
Figure 14:
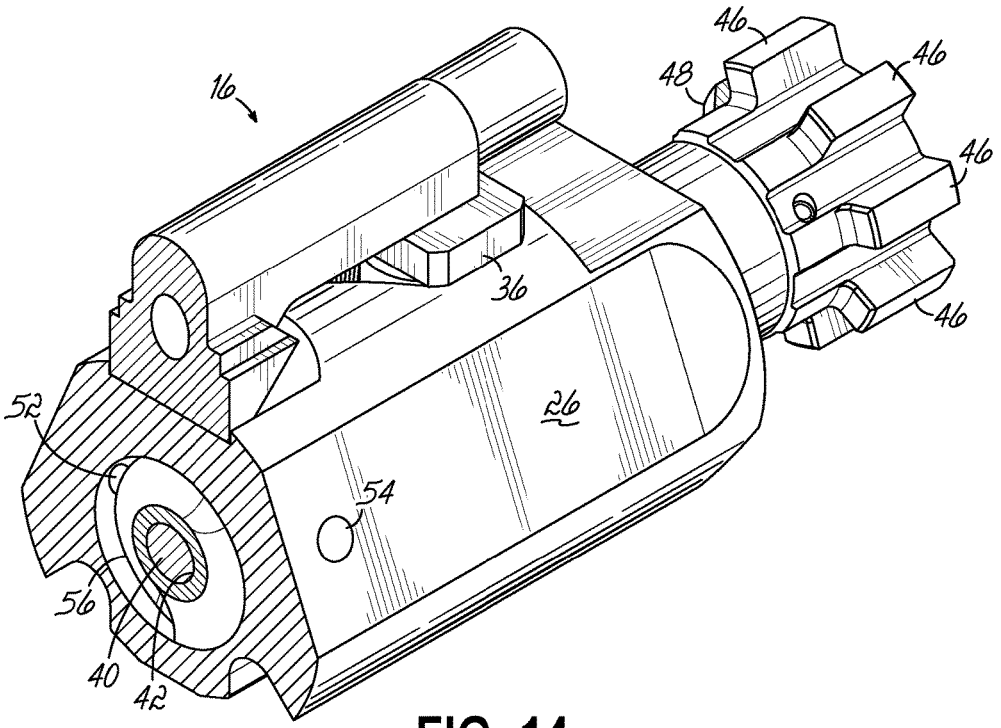
FIG. 14 is an isometric cross-sectional view taken substantially along line 14-14 of FIG. 4.

Referring now in particular to FIGS. 7-10, the bolt 28 includes an extractor 48 and ejector 50, both of which can be of ordinary and well-known construction. When the bolt carrier assembly 16 and bolt 28 are retracted to an out of battery position, the bolt is rotated such that the extractor 48 is positioned at about 67.5 degrees relative to vertical, as illustrated by angle a in FIGS. 9 and 10. The diametrically opposed ejector 50, in cooperation with the extractor 48 that holds a portion of the cartridge rim, causes the casing to be ejected to the side and upwardly at approximately this angle. Because the bolt 28 includes two transverse bores 30, 32 positioned at approximately 135 degrees relative to one another (shown as angle b in FIG. 12), the bolt 28 can be installed in the bolt carrier body 26 with the cam pin 36 selectively inserted into one or the other of the transverse bores 30, 32. Accordingly, these alternate installations allow the bolt 28 to selectively eject a casing through either the left or right ejection port 18, 20 of the upper receiver 12.

No special tools are required for effecting the conversion. Other than having an upper receiver with ejection ports on both sides, the only nonstandard part of the action needed to construct the present invention is a bolt with more than one bore for the cam pin at proper angles relative to the extractor 48 and one another. One embodiment (illustrated) also uses a nonstandard cam pin 36 with a hemispherical end 38 that shares a radial center point with the longitudinal axis 34 of the bolt.

The present invention can be used with either direct impingement or piston gas systems. In a standard, direct impingement AR-pattern bolt carrier, propellant gases are directed through a gas key on the bolt carrier body and into an interior chamber. The interior chamber provides a variable volume cylinder in which an annular shoulder with gas seal rings on the bolt acts as a piston head. As the gas expands in the chamber, the bolt carrier body is pushed to the rear relative to the bolt, causing the bolt to rotate as the cam pin is moved along the helical slot. The essence of the direct impingement operating system is described in U.S. Pat. No. 2,951,424, issued Sep. 6, 1960. The bolt carrier body can include one or more vent openings from the interior chamber that face toward the ejection port of the upper receiver. These vent openings are exposed to communicate with the inside of the chamber as the annular shoulder of the bolt moves and the chamber reaches its maximum volume.

According to an optional feature of one embodiment, the bolt carrier body 26 can include vent ports 52, 54 on both sides and the bolt 28 can include a partial boss 56 adjacent the enlarged annular shoulder 58 that carries the gas seal rings 60. The partial boss 56 may extend for between about 120 degrees and 180 degrees of the circumference and is situated to block venting of gas through the vent port 52, 54 opposite the direction of ejection, while allowing venting on the ejection side. This structure is shown in FIGS. 7A, 7B, 8A, 8B, 13, and 14. Thus, direct impingement gas is vented from the chamber in the direction of the ejector port 18, 20 being used and away from the shooter's face. Reversal of the bolt 28 described above to select the ejection direction automatically positions the partial boss 56 to block the opposite side vent port 52, 54.

Figure 15:
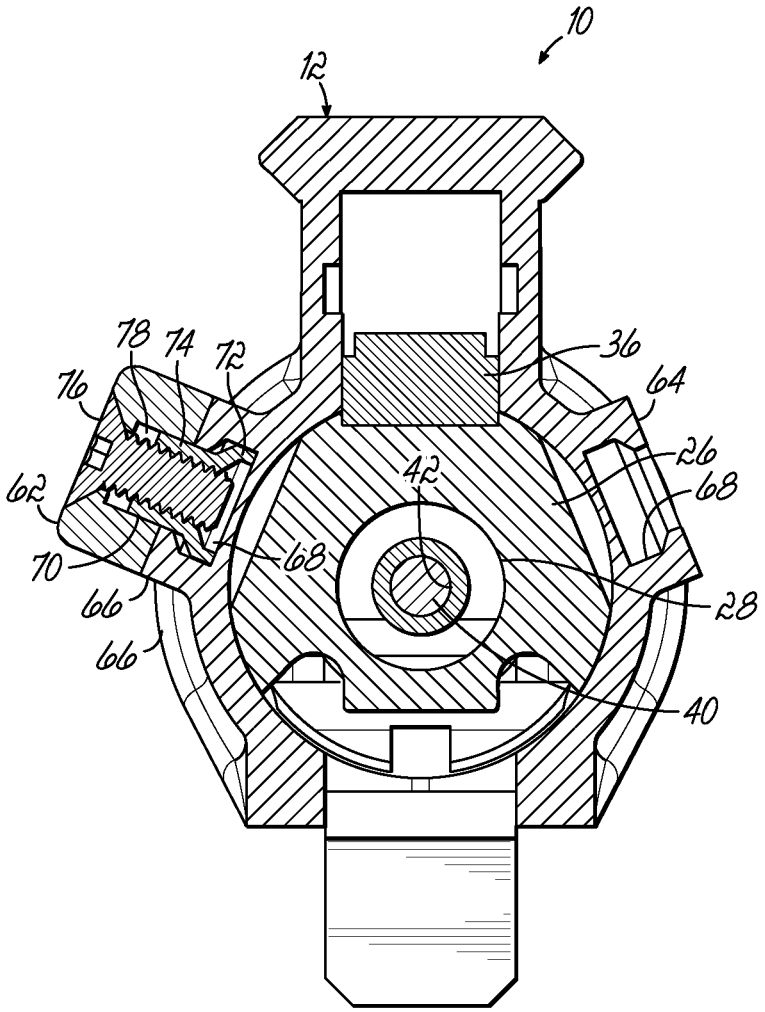
FIG. 15 is a cross-sectional view taken substantially along line 15-15 of FIG. 1.

According to yet another optional feature of one embodiment, as shown in FIGS. 1, 2, and 15, the upper receiver 12 can include a selectively placed shell deflector 62 positioned aft of the ejection port 18, 20 being used. Rather than integrate a shell deflector on both sides of the receiver 12, adding unnecessary weight and projection, the movable shell deflector 62 can be removably attached, such as with a key lock system. The receiver 12 may include a boss 64, 66 on each side that is slotted with a slot or keyhole cut 68, that may be configured according to the KeyMod™ (shown) or M-LOK™ (not shown) open source specifications. In the illustrated embodiment, a KeyMod™ nut 70 can be inserted into the keyhole cut 68 and is engaged by a nut flange 72. The nut 70 includes a threaded socket 74 that receives a threaded fastener 76 which extends through an opening 78 in the removable shell deflector 62. Thus, the shell deflector 62 may be shifted from one side to the other according to the ejection direction selected by the user, determined by the position of the bolt 28.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A bolt carrier assembly for a direct impingement gas-operated firearm, comprising:

a rotating bolt body having a longitudinal axis and having at least first and second transverse bores in the bolt body at an angle to one another converging at the longitudinal axis for selectively receiving a cam pin, an annular shoulder providing a piston surface, and a boss extending around a portion of the annular shoulder;

a bolt carrier body configured to slide within a firearm receiver, the bolt carrier body having a longitudinal bore configured to receive the bolt carrier body and a helical slot configured to guide a cam pin;

a gas chamber defined by a portion of the longitudinal bore and the annular shoulder of the bolt, the annular shoulder defining a movable piston to allow the volume of the chamber to vary when axially displaced relative to the bolt carrier body;

a gas key on the bolt carrier body for directing gas into the gas chamber; and first and second side gas vents, each on opposite sides of the bolt carrier body, providing fluid communication between one portion of the gas chamber and the atmosphere, wherein configuration of the bolt in the bolt carrier with a cam pin in the first transverse bore positions the extractor for interaction with an ejector to eject a cartridge casing to one side and the boss to block the first side gas vent, and configuration with the cam pin in the second transverse bore positions the extractor for interaction with an ejector to eject a cartridge casing to an opposite side and the boss to block the second side gas vent.

2. The firearm bolt of claim 1, wherein the converging transverse bores do not each extend all the way through the bolt body.

3. The firearm bolt of claim 1, wherein the angle between the first and second transverse bores is approximately 135 degrees.

4. A direct impingement gas-operated firearm, comprising:

a receiver having a first ejection port on a first side and a second ejection port on a second, opposite side thereof;

a bolt carrier assembly, comprising:

a rotating bolt body having a longitudinal axis having at least first and second transverse bores in the bolt body at an angle to one another converging at the longitudinal axis for selectively receiving a cam pin, an annular shoulder providing a piston surface, and a boss extending around a portion of the annular shoulder;

a bolt carrier body configured to slide within a firearm receiver, the bolt carrier body having a longitudinal bore configured to receive the bolt carrier body and a helical slot configured to guide a cam pin;

a gas chamber defined by a portion of the longitudinal bore and the annular shoulder of the bolt, the annular shoulder defining a movable piston to allow the volume of the chamber to vary when axially displaced relative to the bolt carrier body;

a gas key on the bolt carrier body for directing gas into the gas chamber; and first and second side gas vents, each on opposite sides of the bolt carrier body, providing fluid communication between one portion of the gas chamber and the atmosphere, wherein configuration of the bolt in the bolt carrier with a cam pin in the first transverse bore positions the extractor for interaction with an ejector to eject a cartridge casing to one side through the first ejection port and the boss to block the first side gas vent, and configuration with the cam pin in the second transverse bore positions the extractor for interaction with an ejector to eject a cartridge casing to an opposite side through the second ejection port and the boss to block the second side gas vent.

5. The firearm of claim 4, wherein the converging transverse bores do not each extend all the way through the bolt body.

6. The firearm bolt of claim 4, wherein the angle between the first and second transverse bores is approximately 135 degrees.

7. The firearm of claim 4, wherein the receiver includes a shell deflector selectively positionable adjacent either of the ejection ports.

8. The firearm of claim 7, wherein the receiver includes a boss adjacent each of the ejection ports to which the shell deflector can be attached with a threaded fastener.

9. The firearm of claim 8, wherein the bosses include a keyhole slot for receiving a flanged nut, the threaded fastener engageable with the flanged nut.

* * * * *